US011825938B2

(12) United States Patent
Deville

(10) Patent No.: US 11,825,938 B2
(45) Date of Patent: Nov. 28, 2023

(54) PORTABLE ERGONOMIC WORKSTATION FOR USE WITH EXERCISE EQUIPMENT

(71) Applicant: Jeffrey Wayne Deville, Ardmore, PA (US)

(72) Inventor: Jeffrey Wayne Deville, Ardmore, PA (US)

( * ) Notice: Subject to any disclaimer, the term of this patent is extended or adjusted under 35 U.S.C. 154(b) by 0 days.

(21) Appl. No.: 17/678,182

(22) Filed: Feb. 23, 2022

(65) Prior Publication Data

US 2023/0043304 A1 Feb. 9, 2023

Related U.S. Application Data

(60) Provisional application No. 63/152,968, filed on Feb. 24, 2021.

(51) Int. Cl.

| | |
|---|---|
| ***A47B 21/02*** | (2006.01) |
| ***A47B 13/08*** | (2006.01) |
| ***A47B 21/03*** | (2006.01) |

(52) U.S. Cl.

CPC ..... *A47B 21/02* (2013.01); *A47B 13/081* (2013.01); *A47B 21/0314* (2013.01); *A63B 2225/68* (2013.01)

(58) Field of Classification Search

CPC ... A47B 21/02; A47B 21/0314; A47B 13/081; A63B 2225/682; A63B 2225/685

USPC ..... 108/3, 42, 152, 50.01, 94, 95

See application file for complete search history.

(56) References Cited

U.S. PATENT DOCUMENTS

| | | | | |
|---|---|---|---|---|
| 2,270,249 | A * | 1/1942 | Birkmeyer | A47B 21/02 181/201 |
| 5,331,904 | A * | 7/1994 | DiSimone | B25H 1/18 108/26 |
| 5,918,841 | A * | 7/1999 | Sweere | A47B 21/00 248/281.11 |
| 6,158,357 | A * | 12/2000 | Shih | A47B 21/00 108/150 |
| 6,908,414 | B1 * | 6/2005 | Roadman | A63B 22/02 482/8 |
| 8,701,567 | B1 | 4/2014 | Esfandiari et al. | |
| 9,980,561 | B1 * | 5/2018 | Constantino | F16M 13/022 |
| 10,004,327 | B2 * | 6/2018 | McRorie, III | F16M 11/30 |
| 10,874,208 | B1 * | 12/2020 | Knapp | A63B 71/0622 |
| 11,569,860 | B2 * | 1/2023 | Gu | A47B 23/06 |
| 2006/0258513 | A1 * | 11/2006 | Routley | A63B 71/0622 482/54 |
| 2007/0069101 | A1 * | 3/2007 | Shevin-Sandy | F16M 11/041 248/441.1 |
| 2020/0170406 | A1 * | 6/2020 | Knapp | A47B 97/00 |
| 2021/0068532 | A1 * | 3/2021 | Blewett | A47B 9/20 |
| 2021/0100365 | A1 * | 4/2021 | Pavlov | A47C 7/70 |
| 2021/0169217 | A1 * | 6/2021 | Hazzard | F16M 11/28 |
| 2021/0298466 | A1 * | 9/2021 | Ramdass | A47B 96/067 |

* cited by examiner

*Primary Examiner* — Jose V Chen

(74) *Attorney, Agent, or Firm* — Joseph R. Heffern

(57) ABSTRACT

A multi-platform, ergonomic workstation that is portable and capable of attaching to different types of exercise equipment, which allows the user to comfortably type, work, or conduct business for extended periods of time while using the exercise equipment. The workstation allows the user to comfortably type or perform work requiring fine motor control while also using the exercise equipment with limited vibration.

16 Claims, 9 Drawing Sheets

PORTABLE ERGONOMIC WORKSTATION FOR USE WITH EXERCISE EQUIPMENT

RELATED APPLICATION

This application claims priority to U.S. Provisional Application 63/152,968.

FIELD OF INVENTION

The present invention relates to a multi-platform, ergonomic workstation that is portable and capable of attaching to different types of exercise equipment, which allows the user to comfortably type, work, or conduct business for extended periods of time while using the exercise equipment.

BACKGROUND

Portable desks and workstations that can be used simultaneously with standard exercise equipment—such as treadmills, elliptical machines, stair climbers, stationary cycles, etc. have become very popular. These portable desks and workstations allow the user to obtain the health benefits of exercise while working, thus avoiding the health problems associated with long periods of daily sedentary work that is common in the modern workplace.

Unfortunately, many portable desks and workstations that are currently available are not sufficiently customizable or ergonomic to allow a user to work productively while exercising for extended periods of time without experiencing significant strain on his or her neck, back, shoulders, arms, or wrists. This is especially true when the exercise equipment, such as a treadmill, requires the user to stand. For example, one such workstation disclosed in U.S. Pat. No. 10,874,208 B1 describes a laptop mount that provides for a single tray on which a laptop may be placed. If the laptop mount is placed at the natural height of the user's hands to type, the user is forced to crane his or her neck downward to look at the screen while working, which produces strain in the neck, shoulders, and back. If the laptop is placed at a height closer to the user's head while working, strain in the user's neck, shoulders, and back is decreased, but strain in the user's arms and wrists substantially increases.

The present invention solves this problem by providing for a multi-platform, ergonomic workstation that is portable and capable of attaching to different types of exercise equipment, which allows the user to comfortably type, work, or conduct business for extended periods of time while using the exercise equipment. By providing for at least two adjustable platforms, one platform can be comfortably placed at the user's eye-level for use with a flat screen monitor or television, laptop, iPad®, or reading material to avoid neck and shoulder strain, while the other can be placed at a lower level with an ergonomic keyboard near the user's hands to avoid arm and wrist strain.

Moreover, each platform is capable of tilting upward and downward from the horizontal position to allow for additional customization and ergonomic positioning based on the individual user's natural body type. For example, it is exceptionally difficult to comfortably type for extended periods of time while walking on a treadmill unless the platform supporting an ergonomic keyboard is tilted upward toward the user's torso so that the user's hands naturally point downward and slightly away from the user's body. By tilting the platform, which holds the keyboard, up toward the user's body, the user does not have to flex or extend his or her wrists for extended periods of time while typing. The angle of the platform can be adjusted to the user's desired preference.

SUMMARY OF THE INVENTION

Embodiments of the invention include an ergonomic workstation, comprised of at least two adjustably connected platforms that are portable and can be attached to various types of exercise equipment—such as treadmills, elliptical machines, stair climbers, stationary cycles, etc. or even furniture. The workstation allows the user to comfortably type or perform work requiring fine motor control while also using the exercise equipment with limited vibration.

DETAILED DESCRIPTION

Certain terminology is used in the following description for convenience only and is not limiting. Similarly, this detailed description provides specific examples of preferred embodiments and does not limit the scope of the claimed inventions. Moreover, this description of example embodiments does not exclude alternative embodiments of the inventions, as would be appreciated by one of ordinary skill in the art.

Figure 1:
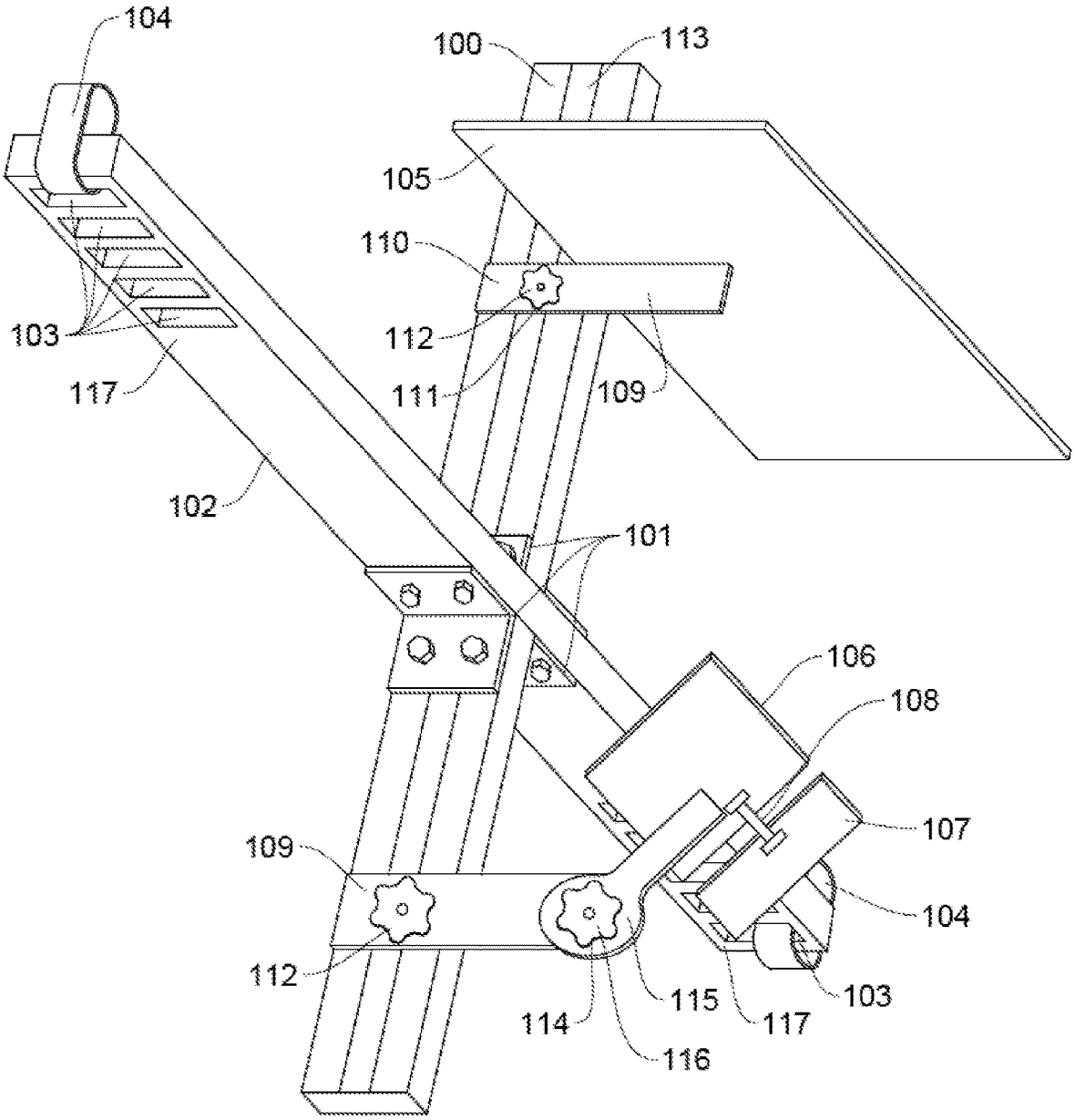
FIG. 1 illustrates an embodiment of a multi-platform, ergonomic workstation: comprising: one vertical segment (100) having a mechanism for attaching (101) one horizontal segment (102), with a mechanism, such as slidable cuffs or a variety of slits (103) and adjustable straps (104), for adjustably attaching the horizontal segment to furniture elements, and two platforms (105 & 106), each having a mechanism for adjustably attaching to the vertical segment. This embodiment includes a third platform (107) that is adjustably attached to the lower platform (106), which can be used for writing or to hold a computer mouse, trackpad, or other computer pointing device. Additional independently adjustable platforms (107) can be attached either to the vertical segment (100) or directly to another platform (106) by another adjustable attachment mechanism (108), such as a removable bolt or lockable hinge, to provide a separate horizontal surface for writing or to be used with a computer mouse or trackpad. In this first embodiment, the platforms (105 &106) are each attached at different heights along a vertical segment (100) by an adjustable attachment mechanism (109), such as by a slidable collar/clamp (110) at least partially encircling the vertical segment (100), which can be tightened and immobilized with a knob (111) attached to a screw (112) & a track (113). Each platform (105 & 106) may employ an adjustable tilting mechanism, such as a tightening knobbed screw or bolt (114) with bracket (115) on a pivot joint (116). One or more surfaces (117) of the horizontal segment (102) can be coated with rubber, a synthetic polymer, or other material to increase friction between the horizontal segment and the exercise equipment to increase the workstation's overall stability and minimize slippage and scratching.
Figure 4:
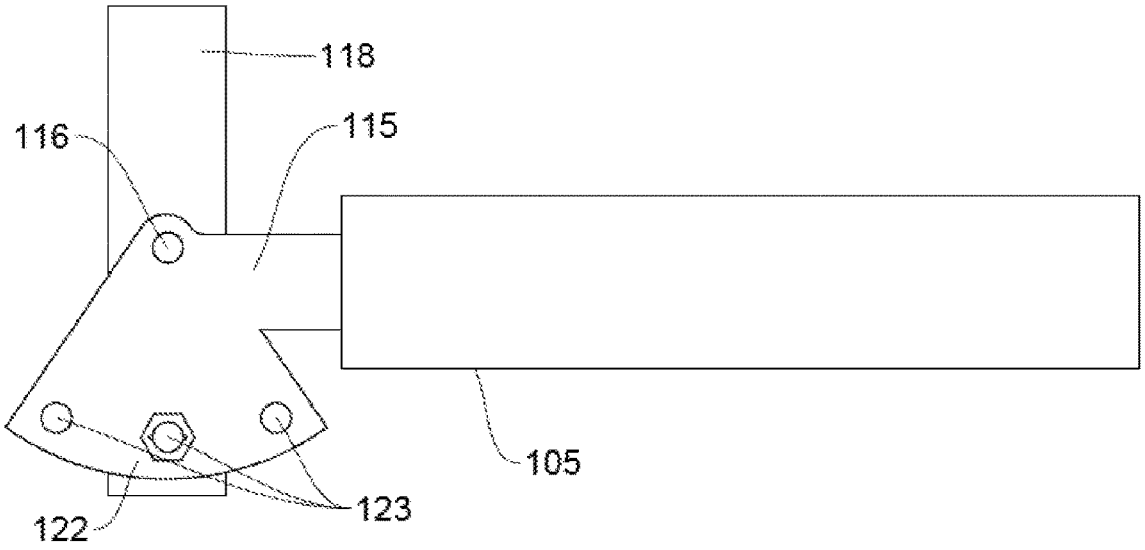
FIG. 4 illustrates the lateral detail of a bracket (115) on a pivot joint (116) attached to a vertical segment (118) with holes (123) and a pin/bolt (122) in an embodiment of a multi-platform, ergonomic workstation to adjustably attach a platform (105) that can tilt upward or downward by moving the pin/bolt (122) to a different hole on the bracket (123).
Figure 5:
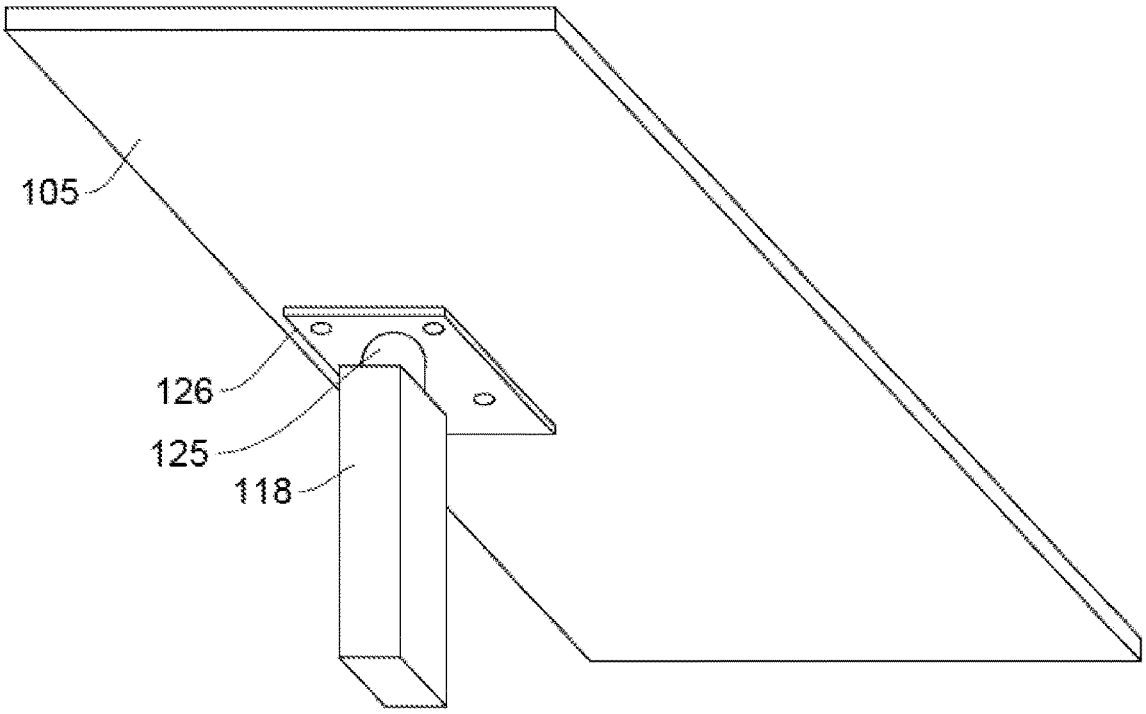
FIG. 5 illustrates the detail of a ball & socket joint (125) attaching an upper platform (105) to a vertical segment (118) of an embodiment of a multi-platform, ergonomic workstation with screws or bolts (126).
Figure 6:
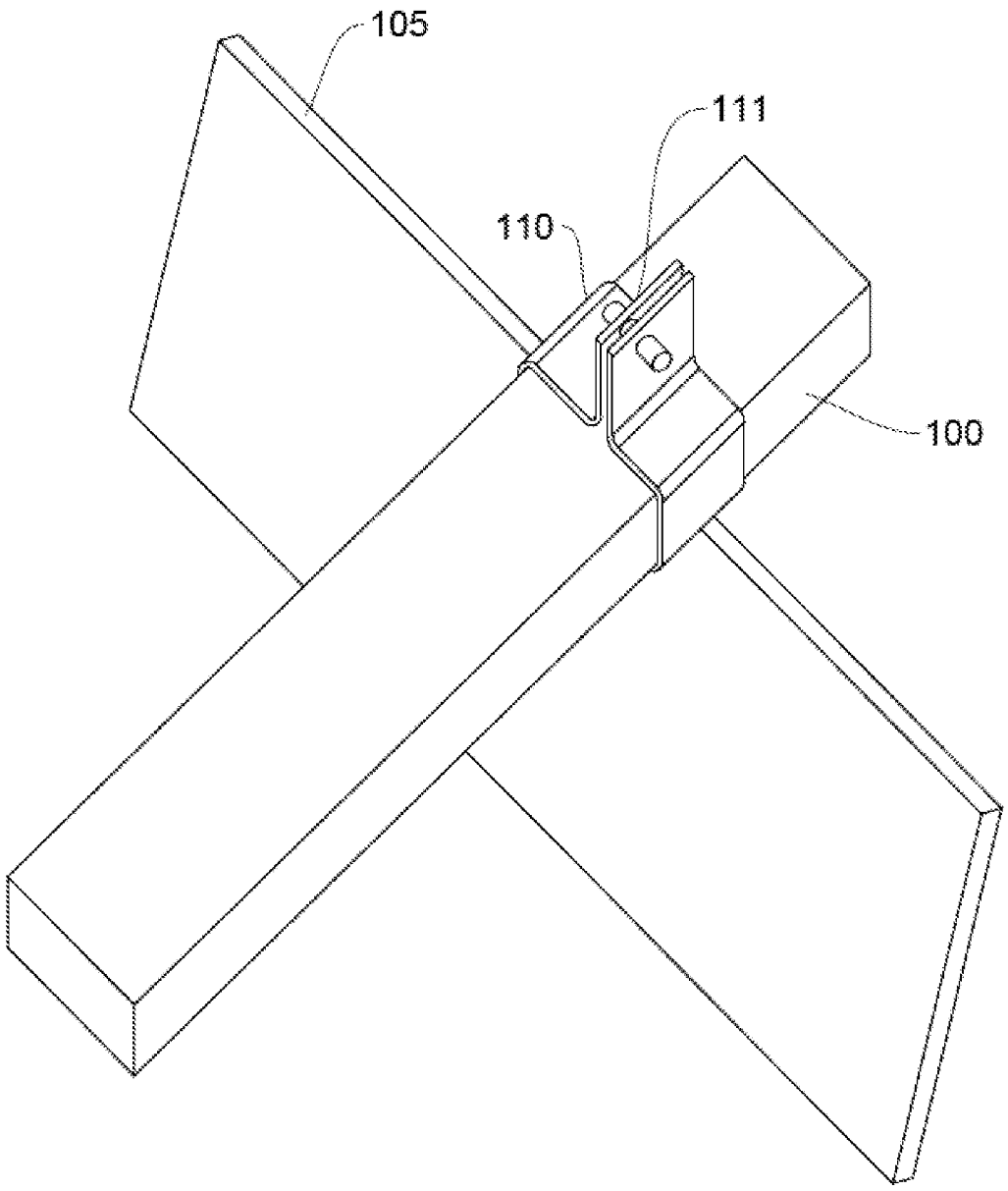
FIG. 6 illustrates the detail of a collar (110) and screw/bolt & nut (111), adjustably attaching a platform (105) to a vertical segment (100) of an embodiment of a multi-platform, ergonomic workstation.
Figure 7:
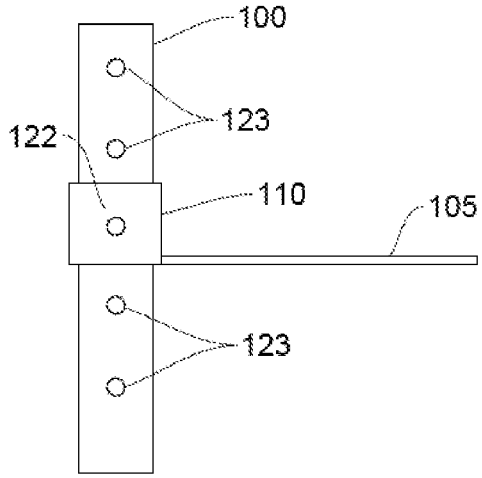
FIG. 7 illustrates the detail of collar (110) employing a pin (122) through a series of holes (123) as an adjustable attachment mechanism to adjustably attach a platform (105) at various heights to a vertical segment (100) of an embodiment of a multi-platform, ergonomic workstation.
Figure 8:
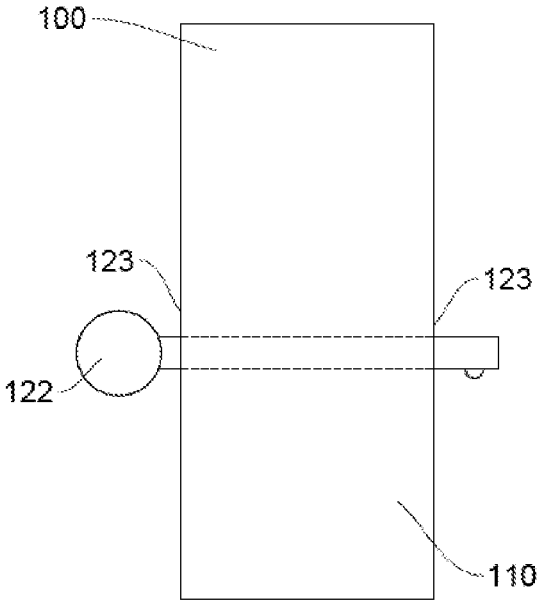
FIG. 8 illustrates the detail of collar (110) employing a pin (122) through holes (123) as an adjustable attachment mechanism to adjustably attach a platform to a vertical segment (100) of an embodiment of a multi-platform, ergonomic workstation.
Figure 9:
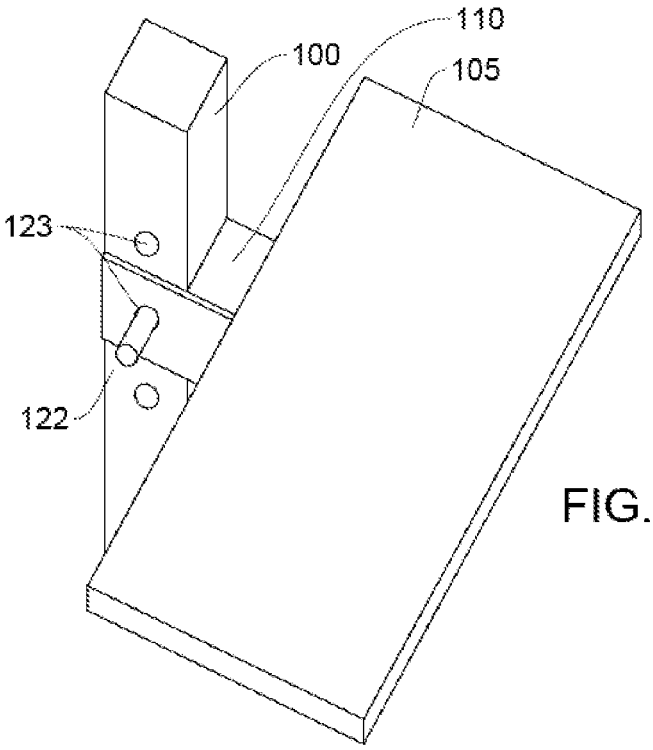
FIG. 9 illustrates the detail of collar (110) employing a pin (122) through a hole (123) as an adjustable attachment mechanism to adjustably attach a platform (105) to a vertical segment (100) of an embodiment of a multi-platform, ergonomic workstation.

One example embodiment provides for at least two platforms or trays (105 & 106) that adjustably attach to at least one vertical segment (100). In this first embodiment (FIG. 1), the platforms are each attached at different heights along a vertical segment (100) by an adjustable attachment mechanism (109), such as a collar/clamp (110) and tightening screw/bolt & nut (112), and track (113), hole (123) & pin or bolt (122), etc. Each platform is adapted to support work equipment or materials such a laptop computer, iPad®, flatscreen television or monitor, ergonomic keyboard, computer mouse/trackpad, or reading material. The vertical segment (100) is also adjustably attached to at least one horizontal segment (102) by an adjustable attachment mechanism, such as L-Brackets (101), collar (110), screw/bolt & nut (122), hole (123) & pin/bolt (111), etc. The vertical segment can have a series of regularly spaced holes (123) or other openings along its length through which the platforms (105, 106) and/or horizontal segment (102) can be attached. Alternatively, it may have a slot or track (113) along it's a portion of its length to facilitate these attachments. The horizontal segment (102) may also have a number of openings (103) along its length through which adjustable straps (104) or other attachment means can be inserted into the openings (103) to anchor the horizontal segment to the handrails of a standard treadmill, other exercise equipment, or furniture. One or more surfaces (117) of the horizontal segment (102) can be coated with rubber, a synthetic polymer, or other material to increase friction between the horizontal segment and the exercise equipment to increase the workstation's overall stability, and minimize slippage and scratching. Each shelf (105 & 106) may employ a tilting mechanism (such as knobbed screw/bolt (114), which can be loosened or tightened to tilt each platform up or down from the horizontal position so as to allow each platform to achieve either a positive or negative slope. This feature allows for a lower platform (106) holding a keyboard to tilt upward (at a positive slope) toward the user's upper body to ergonomically engage the user's hands for typing. Alternative designs for tilting a platform can utilize the ball & socket joint (125) shown in FIG. 5 or a pin/bolt (122) with holes (123) in a bracket (115) shown in FIG. 4. Similarly, a monitor attached to the upper platform (105) can be tilted upward or downward to minimize neck strain, depending on the user's height. Additional independently adjustable platforms (107) can be attached either directly to the vertical segment (100) or directly to another platform (106) by another adjustable attachment mechanism (108), like a bolt or lockable hinge, to provide a separate horizontal surface for writing or to be used with a computer mouse or trackpad.

Figure 2:
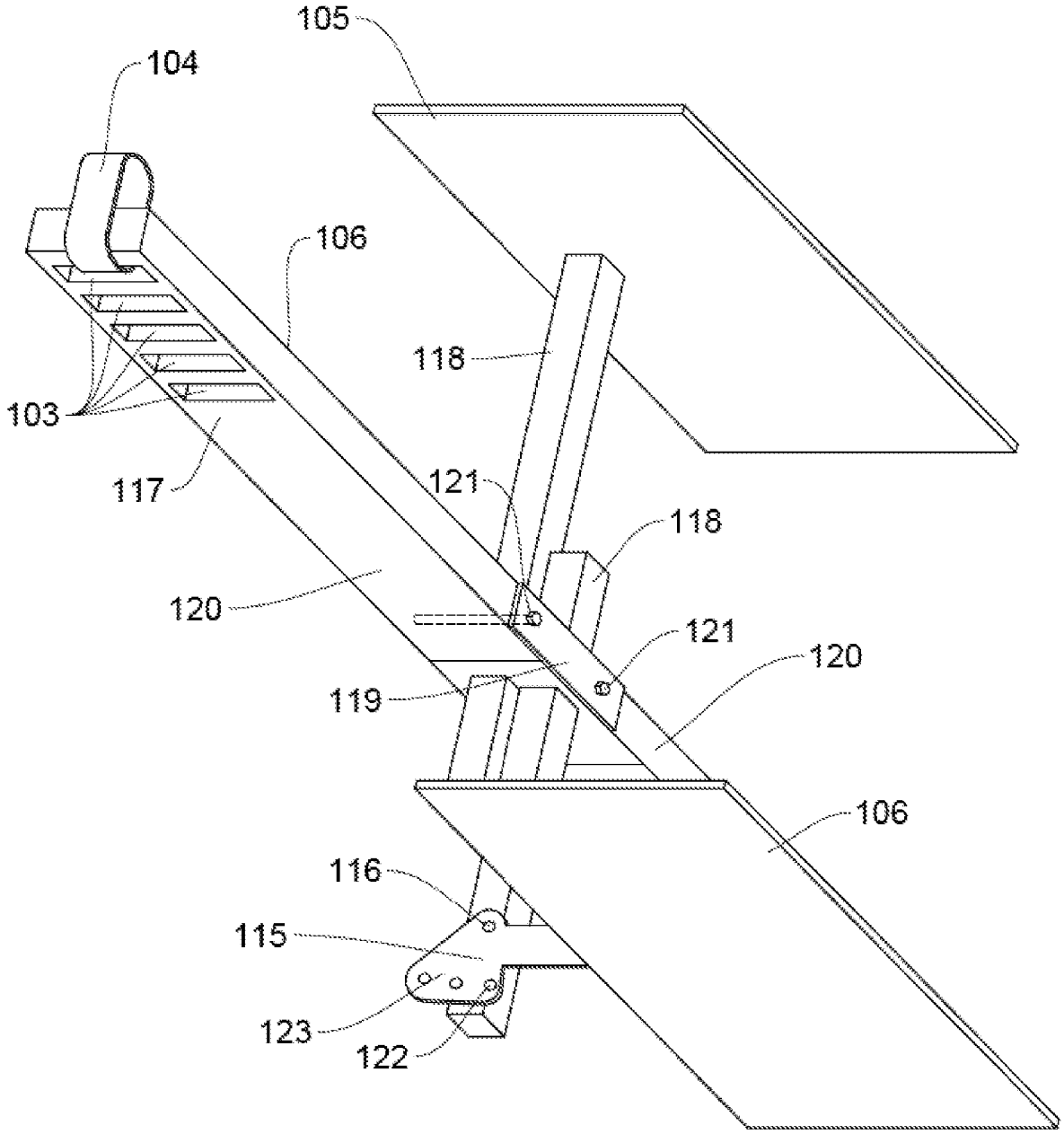
FIG. 2 illustrates an embodiment of a multi-platform, ergonomic workstation comprised of the following: two vertical segments (118) having a mechanism (119), such as a plate or collar, for adjustably attaching two horizontal segments (120), with each having a hinge (121) and a mechanism (such as openings for straps) (103) for adjustably attaching the horizontal segments to furniture elements; one platform (105) attached to one vertical segment (118); and a second platform (106) attached to a second vertical segment (118). The second platform (106) is attached to the second vertical segment (118) by an adjustable tilting mechanism, such as a bracket (115) mounted on a pivot joint (116), which allows adjustment of the second platform's angle of incline and becomes fixed by the tightening of a knobbed screw/pin/bolt (122) through a curved slot or multiple openings (123) in the bracket (116).

In another example embodiment of the invention, two separate vertical segments (180 & 182) are used, such as in FIG. 2. Each vertical segment has a platform or tray (118) attached to one end. Each vertical segment (118) is adjustably attached beside each other by an attachment mechanism, like a plate (119). This plate (119) can also connect two horizontal segments (120). Each vertical segment is capable of independently sliding up or down in the relation to the horizontal segments to adjust the height of each platform using an adjustable attachment mechanism, such as a collar (110) & screw (112), or hole (123) and bolt/pin (122), etc.

Figure 3:
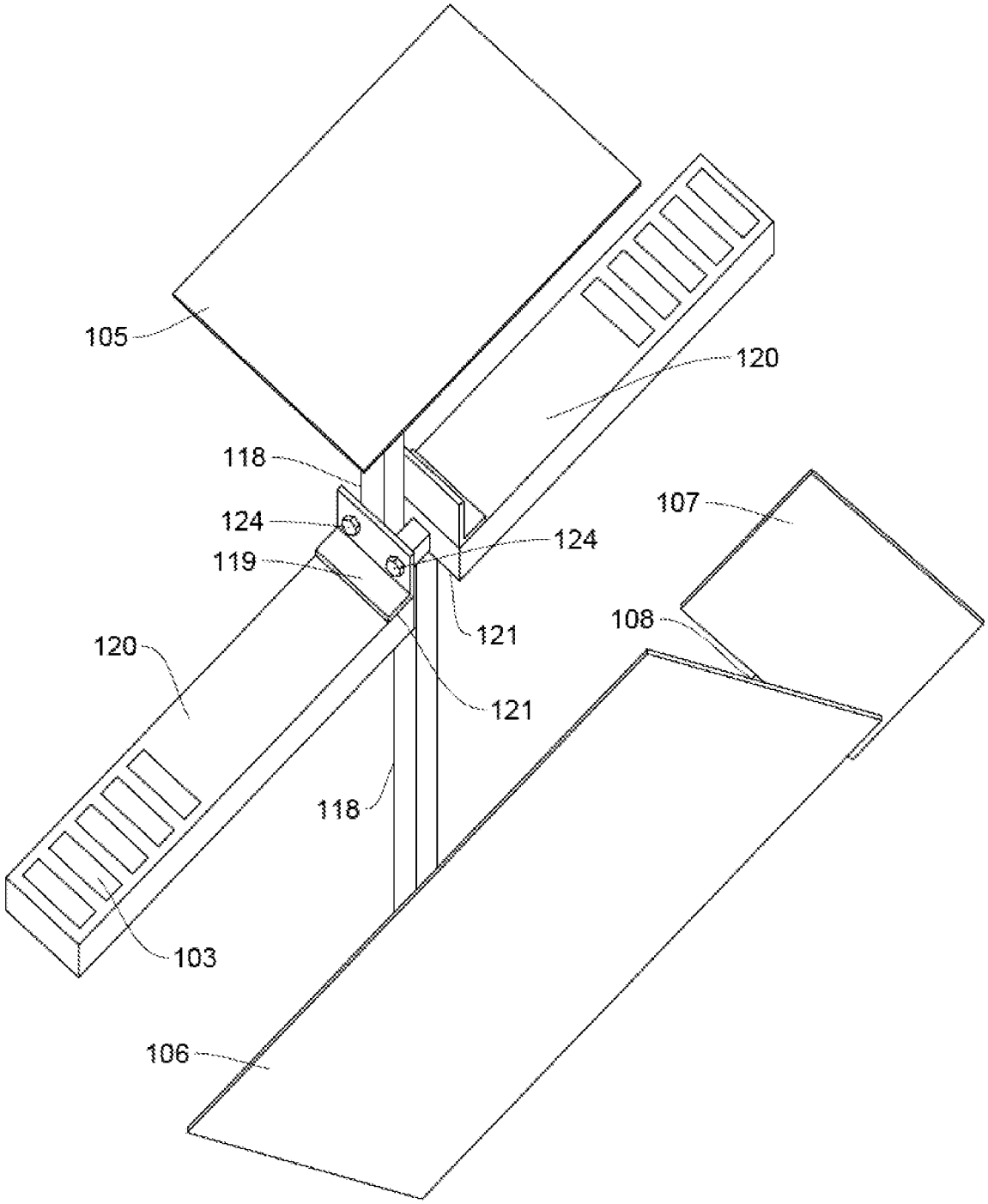
FIG. 3 illustrates an embodiment of a multi-platform, ergonomic workstation comprised of the following: two vertical segments (118) having a mechanism (119), such as a plate or collar, for adjustably attaching two horizontal segments (120), with each having a hinge (121) and a mechanism, such as openings for straps (103), for adjustably attaching the horizontal segments to furniture elements; one platform (105) attached to one vertical segment (118); and a second platform (106) attached to a second vertical segment (118) by an adjustable tilting mechanism. This embodiment includes a third platform (107) that is adjustably attached with a bolt or lockable hinge to the lower platform (106), which can be used for writing or to hold a computer mouse, trackpad, or other computer pointing device.

Another example embodiment, as in FIG. 3, is comprised of two horizontal segments (120) connected to the middle plate (119) by a reversible joining mechanism, such as hinges (121) or a removable bolt or screw and nut, which allows for the horizontal segments to fold together or detach from one another. This allows for more compact transportation and storage of the workstation.

Figure 10:
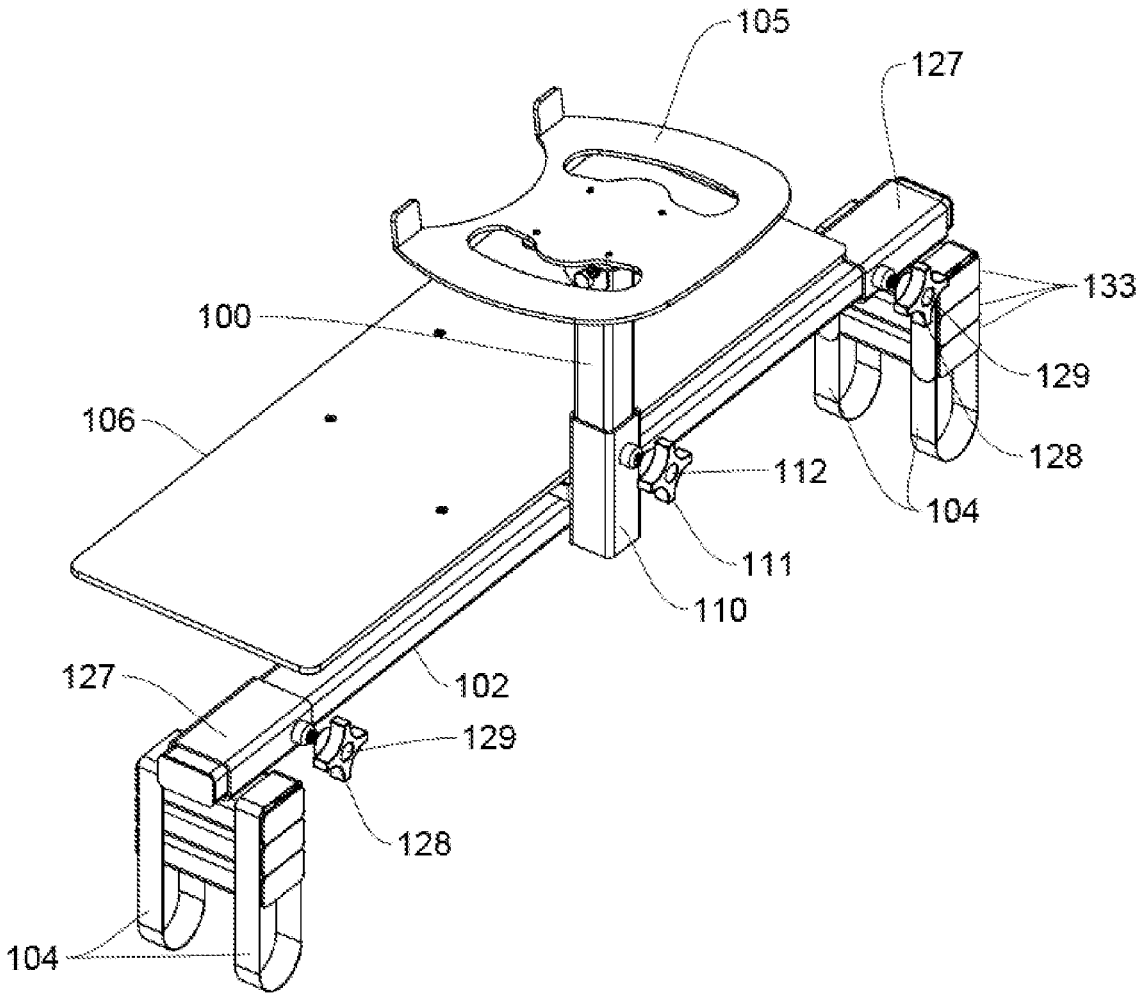
FIGS. 10-12 illustrate an embodiment of a multi-platform, ergonomic workstation, comprising: one horizontal segment (102), with at least two mechanisms, such as slidable cuffs (127), that at least partially encircle the horizontal segment (102), which can be tightened to be immobilized along the horizontal segment with a knob (128) attached to a screw or bolt (129) and adjustable Velcro® straps (104), for adjustably attaching the horizontal segment to equipment or furniture elements, with at least one platform (106), fixedly attached to the horizontal segment (102); a collar or clamp (110), fixedly attached to the horizontal segment (102), capable of slidably attaching one vertical segment (100) having a second platform (105) adjustably attached to one end of the vertical segment through a tiltable bracket (130) with a knob (131) and screw (132) that can be tightened to immobilize the angle of the bracket (130) tilting the platform (105). The collar/clamp (110) at least partially encircles the vertical segment (100), which can be tightened to immobilize the vertical segment with a knob (111) attached to a screw or bolt (112). This embodiment includes interlocking, vibration-dampening spacers (133) that can be attached to the underside of the slidable cuffs (127) on the horizontal segment to increase the distance between the horizontal segment and the attached furniture.
Figure 11:
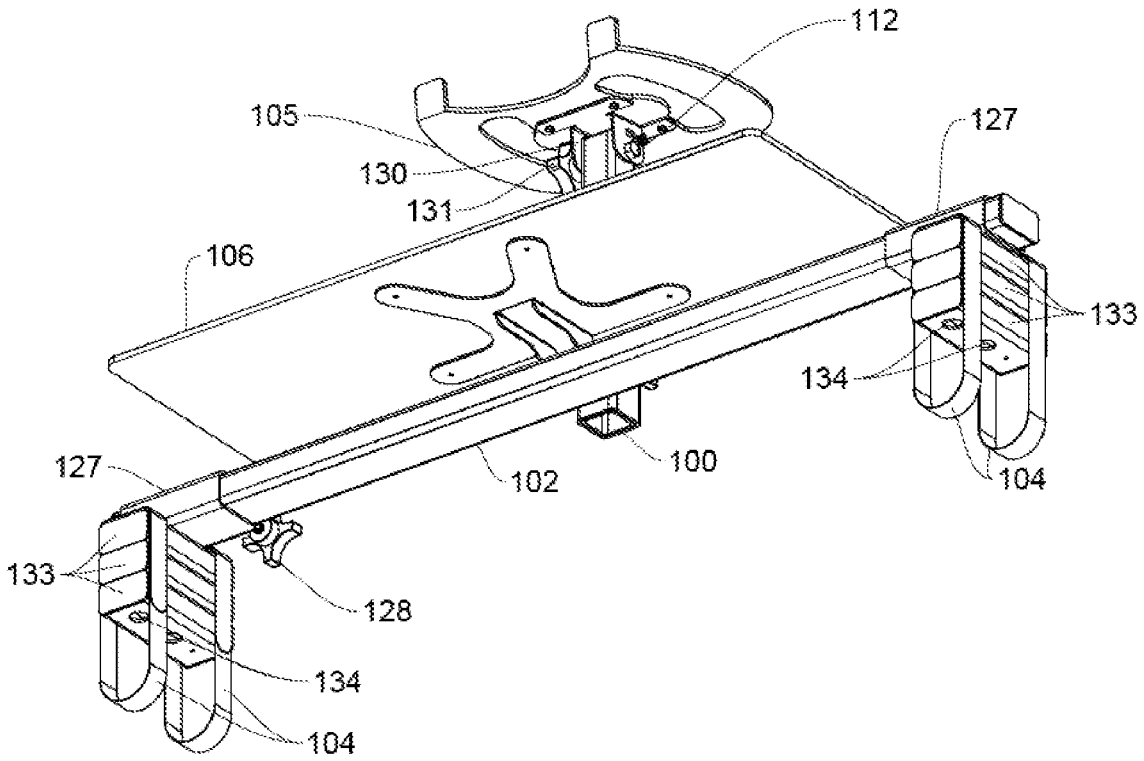
Figure 12:
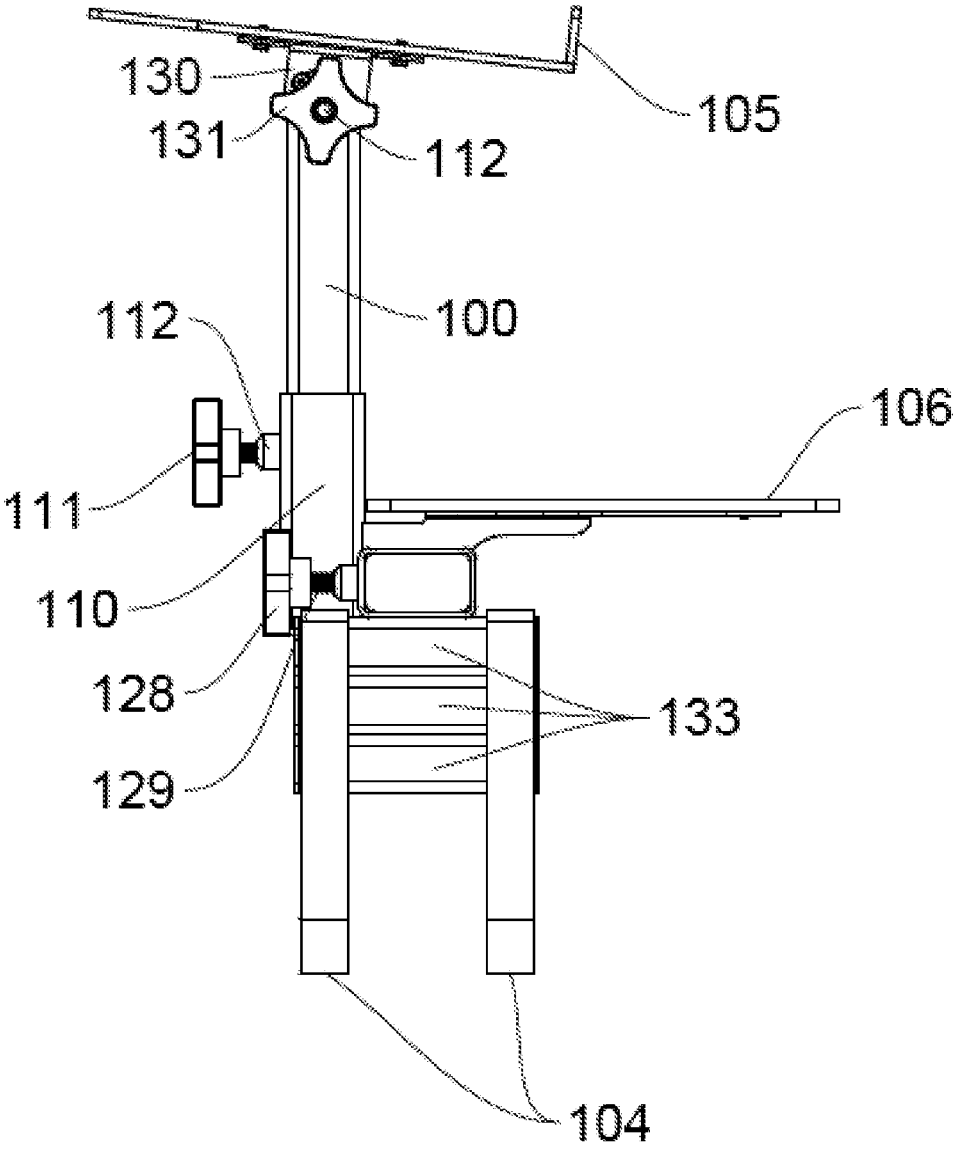

Another example embodiment is displayed FIGS. 10, 11 & 12. This embodiment of a multi-platform, ergonomic workstation, is comprised of the following: one horizontal segment (102), with at least two mechanisms, such as slidable cuffs (127), that at least partially encircle the horizontal segment (102), which can be tightened to be immobilized along the horizontal segment with a knob (128) attached to a screw or bolt (129) and adjustable Velcro® straps (104), for adjustably attaching the horizontal segment to furniture elements, with at least one platform (106), fixedly attached to the horizontal segment (102); a collar or clamp (110), fixedly attached to the horizontal segment (102), capable of slidably attaching one vertical segment (100) having a second platform (105) adjustably attached to one end of the vertical segment through a tiltable bracket (130) with a knob (131) and screw (132) that can be tightened to immobilize the angle of the bracket (130) tilting the platform (105). The collar/clamp (110) at least partially encircles the vertical segment (100), which can be tightened to immobilize the vertical segment with a knob (111) attached to a screw or bolt (112). This embodiment includes interlocking, vibration-dampening spacers (133) that can be attached to the underside of the slidable cuffs (127) on the horizontal segment to increase the distance between the horizontal segment and the attached furniture. The vibration-dampening spacers (133) can be made of a variety of materials, but are preferably comprised of rubber, plastic, or other readily available sound and vibration-dampening materials. One skilled in the art will recognize there are a variety of methods for attaching the dampening spacers to each other and the underside of the slidable cuffs (127), such as through interlocking pieces, snaps, clasps, screws (134), or Velcro® strips.

What is claimed is:

1. An adjustable workstation comprising:

at least one vertical segment having a mechanism for adjustably attaching a horizontal segment;

a horizontal segment having at least two mechanisms for adjustably attaching the horizontal segment to furniture elements, wherein the horizontal segment is comprised of two separate portions, joined end-to-end by a reversible joining mechanism, comprised of at least one set of hinges and at least one bolt, which allows the two separate portions of the horizontal segment fold together for more compact transportation and storage;

a first platform having a mechanism for adjustably attaching to the vertical segment; and a second platform having a mechanism for adjustably attaching to the vertical segment.

2. The adjustable workstation of claim 1, wherein at least one of the platforms includes a mechanism for adjustably tilting the entire platform.

3. The adjustable workstation of claim 1, wherein at least one of the platforms includes a mechanism for tilting a portion of the platform.

4. The adjustable workstation of claim 1, further including a third platform having a mechanism for adjustably attaching to the vertical segment.

5. The adjustable workstation of claim 1, further including a third platform having a mechanism for adjustably attaching the third platform to the second platform and including a mechanism for adjustably tilting the third platform.

6. The adjustable workstation of claim 1, wherein the reversible joining mechanism joining the two separate portions of the horizontal segment end-to-end is comprised of at least one plate with two screws and two nuts, which allows the two separate portions of the horizontal segment to detach from each other for more compact transportation and storage.

7. The adjustable workstation of claim 1, wherein at least one or more vibration-dampening spacers is attached to the underside of horizontal segment.

8. An adjustable workstation comprising:

a horizontal segment having a mechanism for attaching at least two vertical segments to the horizontal segment and at least two mechanisms for adjustably attaching the horizontal segment to furniture elements, wherein the horizontal segment is comprised of two separate portions, joined end-to-end by a reversible joining mechanism, comprised of at least one set of hinges and at least one bolt, which allows the two separate portions of the horizontal segment fold together for more compact transportation and storage;

a first vertical segment, attaching a first platform and having a mechanism for attaching to a horizontal segment;

a second vertical segment, attaching a platform and having a mechanism for attaching to a horizontal segment;

a first platform having a mechanism for adjustably attaching to the first vertical segment; and a second platform having a mechanism for adjustably attaching to the second vertical segment.

9. The adjustable workstation of claim 8, wherein at least one of the platforms includes a mechanism for tilting the entire platform.

10. The adjustable workstation of claim 8, wherein at least one of the platforms includes a mechanism for tilting a portion of the platform.

11. The adjustable workstation of claim 8, further including a third platform having a mechanism for adjustably attaching the third platform to the second platform and including a mechanism for tilting the third platform.

12. The adjustable workstation of claim 8, wherein the horizontal segment is comprised of two separate portions, joined end-to-end by a reversible joining mechanism.

13. The adjustable workstation of claim 8, wherein at least one or more vibration-dampening spacers is attached to the underside of horizontal segment.

14. An adjustable workstation comprising:

at least one vertical segment having a mechanism for adjustably attaching a horizontal segment;

a horizontal segment having at least two mechanisms for adjustably attaching the horizontal segment to furniture elements, wherein the horizontal segment is comprised of two separate portions, joined end-to-end by a reversible joining mechanism, comprised of at least one set of hinges and at least one bolt, which allows the two separate portions of the horizontal segment fold together for more compact transportation and storage;

a first platform having a mechanism for adjustably attaching to the vertical segment; and a second platform having a mechanism for fixedly attaching to the horizontal segment.

15. The adjustable workstation of claim 14, wherein at least one or more vibration-dampening spacers is attached to the underside of horizontal segment.

16. An adjustable workstation comprising:

at least one vertical segment having a mechanism for adjustably attaching a horizontal segment;

a horizontal segment having at least two mechanisms for adjustably attaching the horizontal segment to furniture elements, wherein at least two or more stackable, vibration-dampening spacers are attached to the underside of the horizontal segment to adjust the distance and amount of vibration between the horizontal segment and the attached furniture elements;

a first platform having a mechanism for adjustably attaching to the vertical segment; and a second platform having a mechanism for adjustably attaching to the vertical segment.

* * * * *